United States Patent [19]

Martin

[11] 4,022,183

[45] May 10, 1977

[54] TRACK SYSTEM FOR OVEN WINDOW SHUTTER ON SELF CLEANING OVEN

[75] Inventor: Douglas Earl Martin, Mississauga, Canada

[73] Assignee: GSW Limited-GSW Limitee, Toronto, Canada

[22] Filed: Apr. 14, 1976

[21] Appl. No.: 676,705

[52] U.S. Cl. ..... 126/200

[51] Int. Cl.[2] ..... F23M 7/00

[58] Field of Search ..... 126/198, 200, 197

[56] References Cited

UNITED STATES PATENTS

| | | | |
|---|---|---|---|
| 3,507,267 | 4/1970 | Lafforgue | 126/200 |
| 3,717,138 | 2/1973 | Upp | 126/200 |
| 3,881,462 | 5/1975 | Barnett | 126/197 |

*Primary Examiner*—John J. Camby
*Assistant Examiner*—Larry I. Schwartz

[57] ABSTRACT

A track system for suspending and guiding the movement of a shield to and from a window-covering position in an oven door for a self-cleaning oven when an oven is to be operated at high temperatures to clean the interior surfaces of the oven and the oven door. A linear motion bearing means is provided to suspend the moveable shield by a first end portion within the oven door where the shield moves along the linear motion bearing means to and from a position which covers and shields a transparent pane in an oven door. A second end portion of the moveable shield opposite the first end portion of the shield is free whereby thermal expansion in the moveable shield is accommodated.

14 Claims, 10 Drawing Figures

TRACK SYSTEM FOR OVEN WINDOW SHUTTER ON SELF CLEANING OVEN

FIELD OF THE INVENTION

This invention relates to oven doors for use with an oven which is capable of being operated at high temperatures for purposes of cleaning an oven and, in particular, to a track system which facilitates the raising and lowering of a shield within an oven door to cover an oven window pane when an oven is operating at high temperatures.

Background of the Invention

In a domestic stove, a self-cleaning cycle is often used to clean the interior surfaces of its oven. The oven interior is raised to a sufficiently high temperature which causes thermal decomposition of grease, grime and other material which results from the normal use of an oven so that upon completion of a self-cleaning cycle, the oven is virtually free of the material. The temperatures achieved in the oven during the cleaning cycle may reach or surpass those which can cause a pyrolytic cleaning of the oven interior. Where a window is provided in the oven door with one or more transparent panes, it is desirable for safety reasons to cover or shield the pane or panes from thermal radiation generated by an oven operating at high temperatures so as to substantially reduce the temperature on the exterior surface of the outer window pane. It is therefore necessary to provide a system which enables one to raise and lower a shield or shutter to cover a transparent pane in a window and which is not damaged by thermal expansion in the components when the oven is operated at high temperatures.

It is therefore an object of the invention to provide a track system which facilitates the raising and lowering of a shield in an oven door to overcome jamming of the shield when moved within the oven door and accommodate thermal expansion in the shield to eliminate buckling thereof when an oven is operated at high temperatures.

It is another object of the invention to provide a linear motion bearing means to which a first end of a shield is attached so that the shield is suspended in a cantilever manner in an oven door when the oven door is in an oven-closing position.

It is yet another object of the invention to provide guidance means in combination with a linear motion bearing means to guide the movement of a second end of the shield so that shield does not interfere with parts interior of the oven door and does not rattle during opening and closing of the oven door.

It is a further object of the invention to provide a mechanism in combination with the track system which locks the oven door shut in preparation for the self-cleaning cycle in the oven when the shield is raised to the window-covering position.

It is yet a further object of the invention to provide a mechanism which is adapted to accommodate a limited degree of freedom of movement in a locking mechanism for an oven door without causing movement in the shutter when the shutter is in the transparent pane-covering position during the self-cleaning cycle.

BRIEF SUMMARY OF THE INVENTION

In order to suspend and positively guide the movement of a shield or shutter in an oven door to and from transparent pane-covering position, a linear motion bearing means is provided to which an end portion of the shield is attached so that the shield is suspended within the oven door. When the oven door is in the raised position, the shield is suspended within the oven door by the linear motion bearing means in a cantilever manner so that the second end portion of the shield is free. The track system according to this invention therefore accommodates thermal expansion in the shield during operation of the oven at high temperatures. The free second end of the shield permits movement of the shield to and from transparent pane-covering position without causing any jamming or cocking of the shield on the track means since the first end portion of the shield is the only portion attached to a linear motion bearing means.

According to an aspect of the invention, guidance means may be provided at the second end portion of the shield to ensure that the movement of the shield to and from transparent pane-covering position does not interfere with other parts of the oven door. The guidance means may be adapted to guide the shield so that its movement is in a plane parallel to a plane defined by a transparent pane in the oven door.

The guidance means would be adapted to accommmodate thermal expansion in the shield.

The concept of mounting a shield in an oven door in this manner lends itself to the use of various types of mechanisms for raising and lowering the shield. According to one aspect of the invention, the mechanism for raising and lowering the shield may be adapted to simultaneously lock the oven door shut when the shield is raised to the transparent pane-covering position.

Accordingly, in an oven door having a transparent window pane for use on an oven, the oven door includes spaced-apart outer and inner door panels with aligned apertures which define a window opening. A moveable shield is positioned between the outer and inner door panels and it is adapted to be moved to a position to cover and to shield a transparent pane from thermal radiation generated by an oven operating at high temperatures and to be moved to a position to uncover the transparent pane and leave the window opening unobstructed to permit viewing into an oven. A linear motion bearing means has a first end portion of the moveable shield mounted thereon. The linear motion bearing means is adapted to suspend the movable shield by the first end portion within the oven door where transverse movement of the moveable shield is essentially precluded. Means for moving the moveable shield along the linear motion bearing means is provided and is adapted for releasably holding the shield in a transparent pane-covering position. The arrangement is such that the linear motion bearing means positions and guides movement of the moveable shield to and away from a position which covers an oven door transparent pane. A second end portion of the moveable shield opposite the first end portion is free whereby thermal expansion of the movable shield is accommodated during operation of the oven at high temperatures.

Various types of linear motion bearing means may be used in suspending the shield within an oven door, the function of which will become more apparent in the following detailed description of the preferred embodiments.

DESCRIPTION OF THE DRAWINGS

The aforementioned and other objects, advantages and features of the invention will become apparent in the following detailed description of the preferred embodiments according to this invention, as shown in the drawings, wherein.

DETAILED DESCRIPTION OF THE PREFERRED EMBODIMENTS

Figure 1:
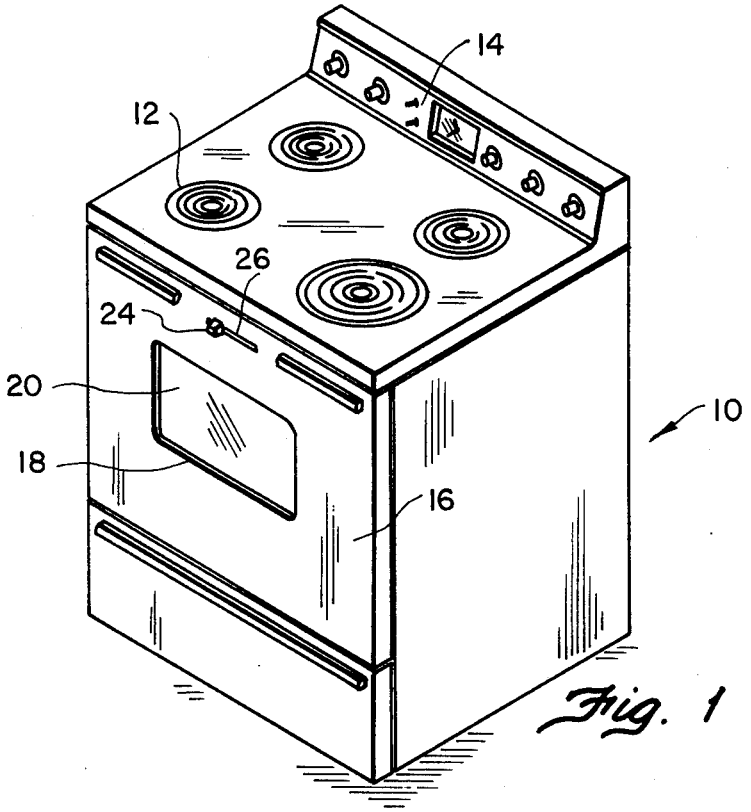
FIG. 1 is a perspective view of a stove having an oven door according to a preferred embodiment of the invention.

A stove 10 as shown in FIG. 1 has hot plate elements 12, control panel 14, and an oven cavity covered by an oven door 16. The stove is adapted to raise the oven temperatures to self-cleaning temperatures which will cause decomposition of grease and grime resulting from cooking within the oven so as to rid the oven of this material. During the operation of the self-cleaning cycle of such an oven, the window opening 18 having transparent pane 20 will rise to very high temperatures if not shielded.

Figure 2:
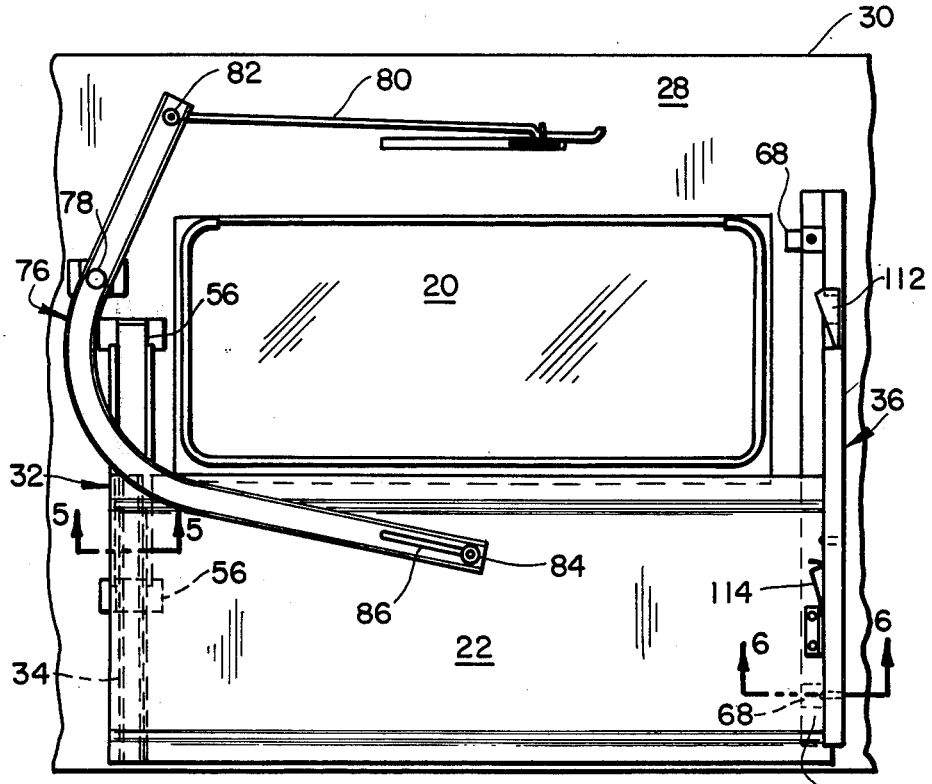
FIG. 2 is a section of the oven door of FIG. 1 showing the interior surface of the outer panel of the oven door with the track system and shield mounted thereon.

As shown in FIG. 2, a shield or shutter 22 can be raised to cover transparent pane 20 and shield it from the thermal radiation generated by the oven operating at high temperatures. A knob 24 is provided exterior of the door which is moved to and fro within slot 26 to activate the mechanism for raising and lowering the shutter 22 to a position which covers transparent pane 20.

A back panel of the oven door (not shown in FIG. 2) is secured to the front panel 30 to provide the completed oven door. It is understood that the inner panel of the oven door would include a window having one or more transparent panes mounted therein.

A linear motion bearing means 32 is mounted on the interior surface 28 of the door panel 30. A first end portion 34 of shield 22 is mounted on the moveable component of linear motion bearing means 32. The linear motion bearing means 32 is positioned within the oven door in a manner to guide the movement of shield 22 to and away from a position which covers transparent pane 20. A guidance means 36 is attached to the inner surface 28 and serves to guide the movement of second end portion 38 of shield 22.

Figure 5:
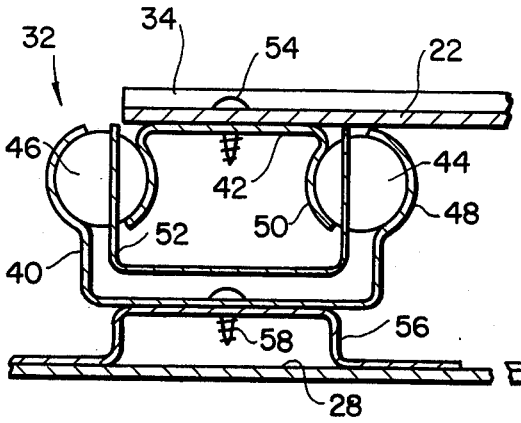
FIG. 5 is a section taken along lines 5—5 of FIG. 2.

As can be appreciated, various types of linear motion bearing means may be used for suspending the shield 22 within the oven door. For example, slide members may be positioned within an enclosing type of channel member where the shield is secured to the slide members which support or suspend the shield within the oven door. According to a preferred embodiment of this invention, a ball bearing type of linear slide is used which is shown in more detail in FIGS. 5 and 6. The linear motion bearing means 32 may therefore include a stationary component 40 which has essentially a channel-shaped cross section and a moveable component 42 which also has a channel-shaped cross section and is narrower than channel 40 so as to be positioned within channel 40 in an inverted manner. Between the stationary component 40 and moveable component 42, two ball bearing races 44 and 46 are provided which contact arcuate surface 48 of stationary component 40 and arcuate surface 50 of moveble component 42. It is understood that the shape of arcuate surfaces 48 and 50 may be varied so that there is either double or single point contact between ball bearing races 44 and 46 and the arcuate surfaces. A keeper member 52 is provided to ensure that the ball bearings stay within ball bearing races 44 and 46. The first end portion 34 of shield 22 is secured to the moveable component 42 by self-tapping screws 54. The stationary component 40 is secured to a bracket 56 by self-tapping screw 58 which is in turn spot-welded to the interior surface 28 of outer door panel 30. A bracket may be provided at the top and bottom of the stationary component 40. The second end 38 of shield 22 is positioned in guidance means 36 which consists of a channel member 60 having two leg portions 62 and 66 where leg portion 66 is secured to bracket 68 by self-tapping screw 70. Bracket 68 is spot-welded to the interior surface 28 of the outer panel 30.

Figure 4:
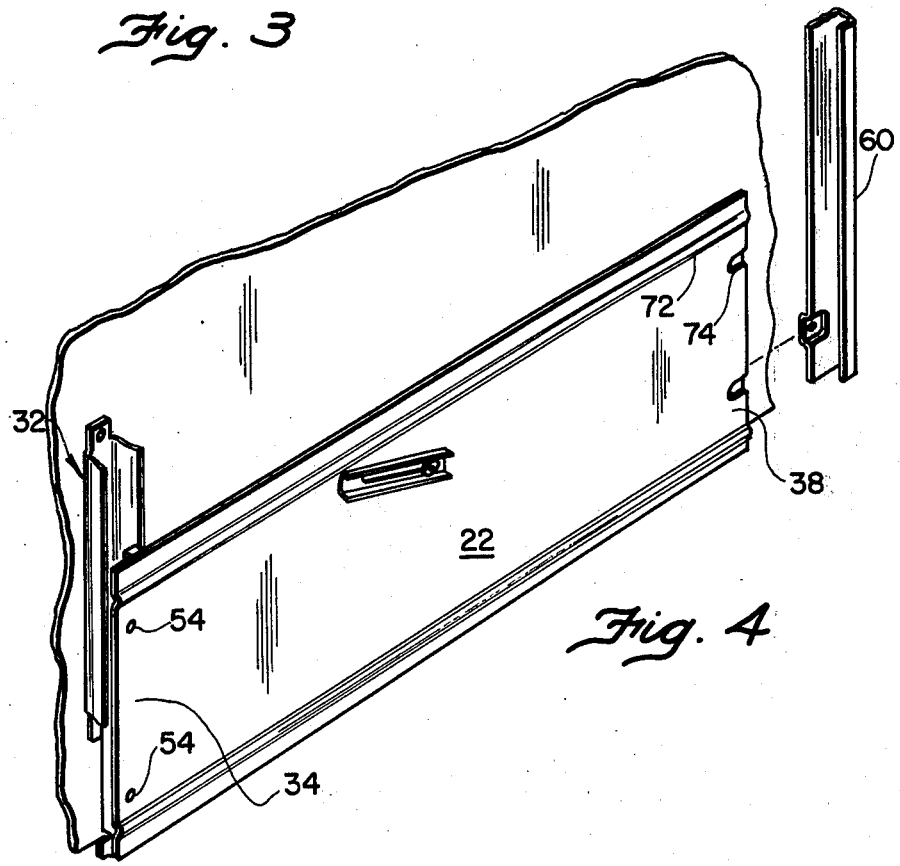
FIG. 4 shows the cantilevered suspension of the shield on the outer panel of the oven door with guidance means moved aside from the shield.

Turning to FIG. 4, it can be appreciated that with the shield 22 secured at its first end 34 to the moveable component 42 of the ball bearing slide, with the oven door in a raised position, the shield 22 is suspended within the oven door in a cantilever manner with the second end 38 of the shield being suspended freely in the oven door. The channel member 60 of the guidance means 36 is placed over the free end 38. As more clearly shown in FIG. 6, there is a clearance between the second end 38 of the shield and the channel legs 62 and 66 to permit free movement of the shield within the guidance means 60. To reduce the amount of rattling of the free second end 38 of the shield in the channel 60, dimples 72 and 74 are provided at the top and bottom of the shield which extend from the shield surfaces in opposing directions to provide point contact along the channel legs 62 and 66 as the shield moves up and down in the channel 60. It is understood that the clearance of the second end 38 in the channel 60 may be significantly less than that shown in FIG. 6 and there may even be a slight negative clearance where the flexibility of the shield still permits a free sliding motion of the shield within the channel 60 so that for all intents and purposes, the second end 38 of the shield is free to move about.

The linear motion bearing means 32 as mentioned, is adapted to suspend the shield 22 within the oven door in a cantilever manner. With the ball bearing slides shown in FIG. 5, ball bearing races 44 and 46 include at least two ball bearings in each race so that the channel member 42 is firmly positioned within channel member 40 so as to essentially preclude any transverse movement of the channel 42. With the oven door in a raised position, the shield is suspended horizontally from the linear motion bearing means. The linear motion bearing means does not permit the shield 22 to move back and forth in a horizontal direction so that transverse movement of the shield 22 relative to its raising and lowering movement is essentially precluded.

Figure 3:
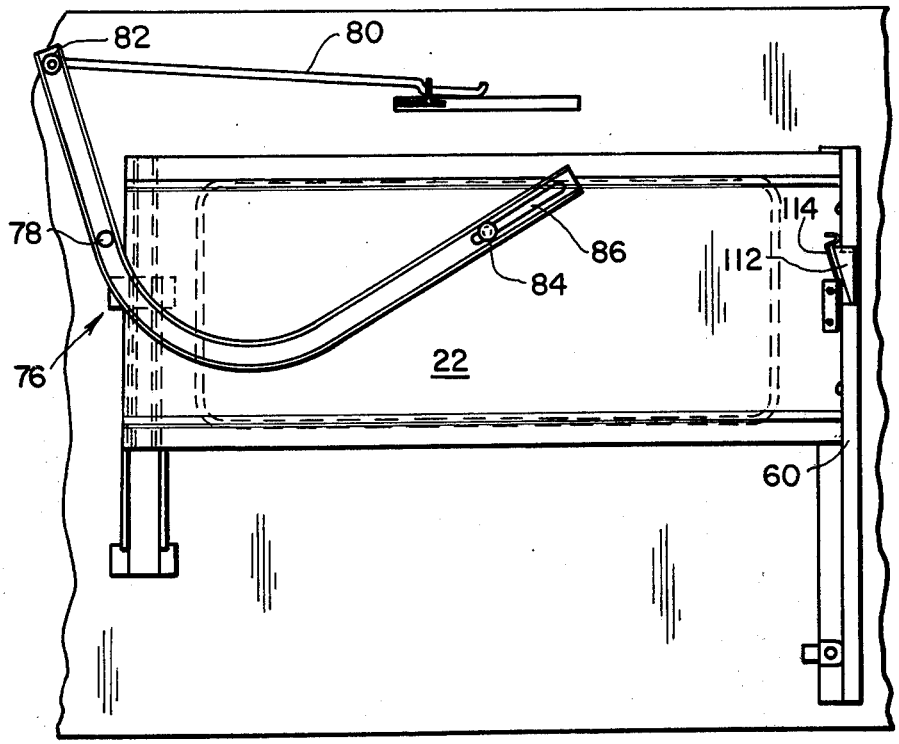
FIG. 3 shows the shield of FIG. 2 in its raised transparent pane-covering position.

Various types of mechanisms may be used for raising and lowering the shield 22. For example, a rod or lever attached to the shield 22 may project outwardly through the oven door plug which may be grasped by a person for purposes of raising the shield to cover the transparent pane. According to a preferred embodiment of this invention, a mechanism as shown in FIGS. 2 and 3 is used which is adapted to simultaneously raise the shutter and lock the oven door closed. According to this aspect of the invention, the means for raising and lowering the shield 22 comprises an L-shaped lever arm 76 which is pivoted about a staionary point 78. Pivotally connected to arm 76 is a horizontal link arm 80 which is connected to lever arm 76 at 82. The L-shaped lever arm 76 is pivotally connected to the shield at 84 where a slot 86 is provided in the longer portion of arm 76 to accommodate the swinging motion of the arm 76 in an arc. Pivot point 84 is stationary on shield 22 so that as arm 76 is raised to the position shown in FIG. 3, the pivot point 84 moves downwardly along slot 86. The shape of arm 76 is chosen so that it is never visible when viewing through transparent pane 20. When the shield is in the raised position, it blocks the view of the L-shaped lever arm 76. The position of pivot point 78 is selected so that for a small degree of horizontal movement of the actuation knob 24, the arm 76 swings through a sufficient arc to raise the shield to a transparent pane-covering position.

Figure 7:
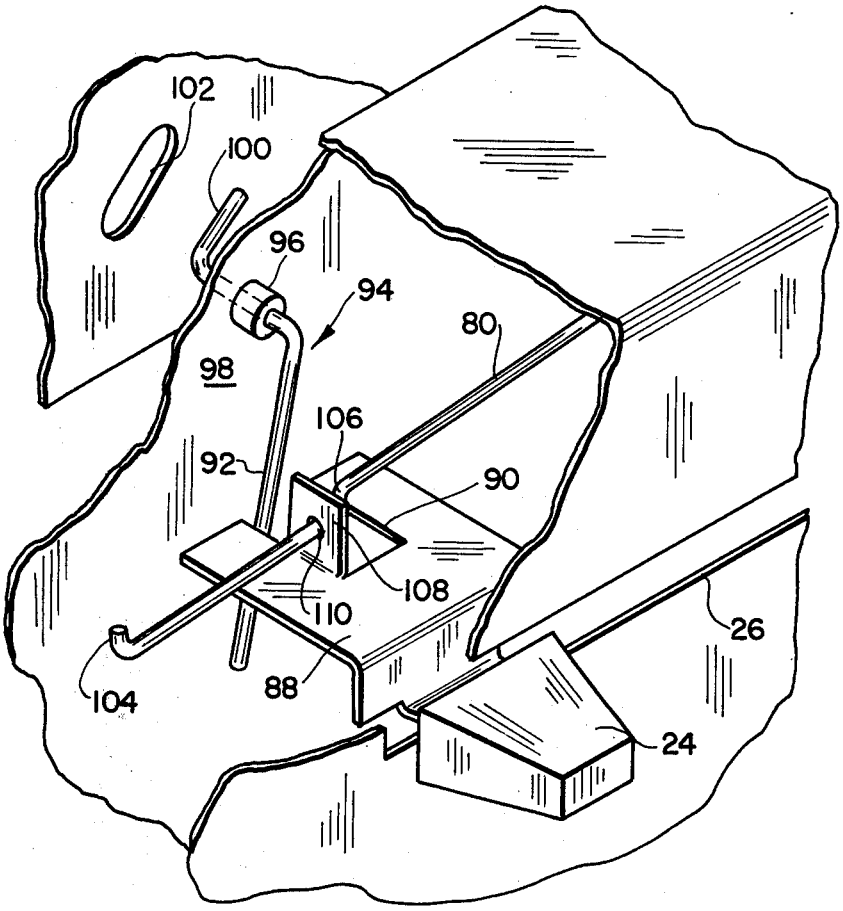
FIG. 7 shows a preferred construction of the actuation means for raising and lowering the shield.

As more clearly shown in FIG. 7, the actuator knob 24 as it slides through slot 26 in the outer door panel has a plate 88 secured thereto which has a yoke portion 90 for grasping an arm 92 of locking lever 94. The locking lever 94 is bearingly mounted at 96 in the inner door panel 98 of the oven door and a second arm 100 of the locking lever projects externally of the back wall of the oven door. The second arm 100 fits within the slot 102 of the oven body and is rotated to lock the oven door closed. The horizontal link arm 80 is provided with two stops 104 and 106 which permit plate 80 to move between the stops 104, 106 as determined by tab 108 with an aperture 110 which slides along the link arm.

Figure 8:
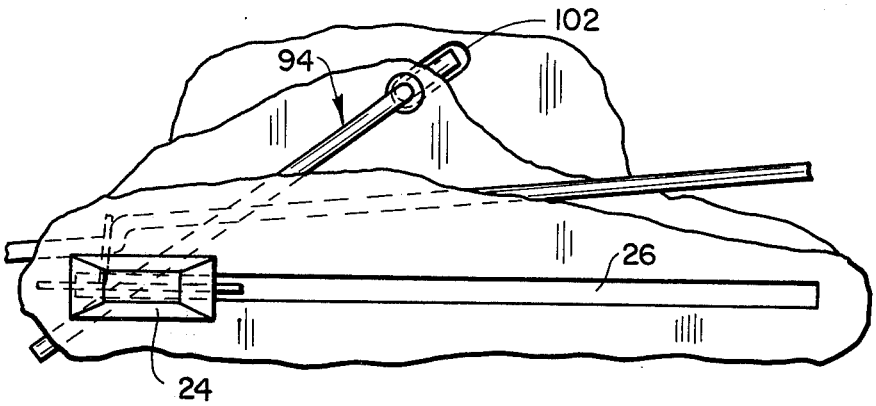
FIGS. 8, 9 and 10 show the actuation means of FIG. 7 in various positions for raising and lowering the shield.
Figure 9:
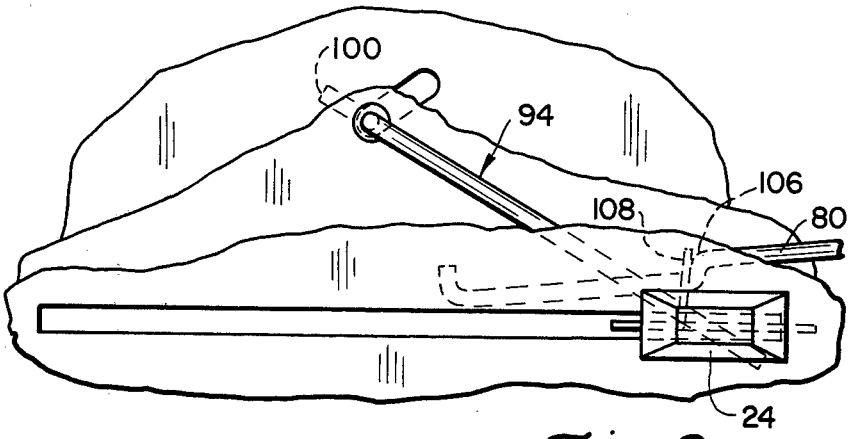
Figure 10:
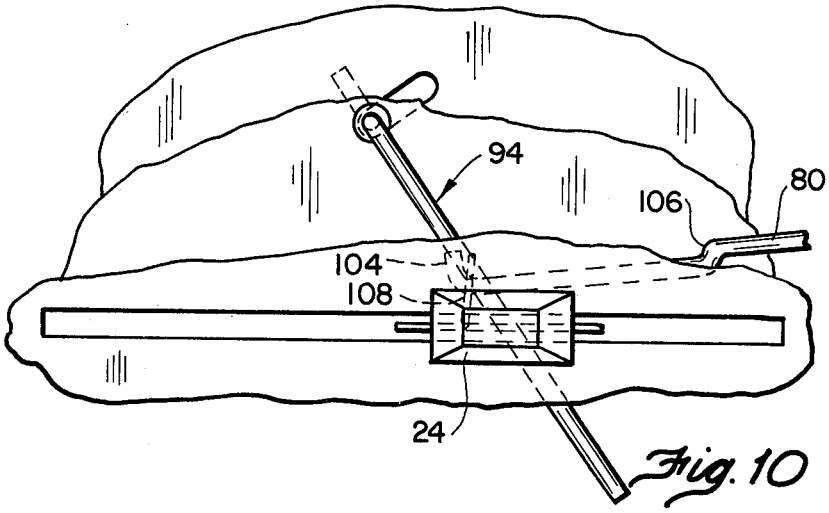

Turning to FIGS. 8, 9 and 10, the provision of the stops 106 and 104 become apparent. With FIG. 8 the section of the oven door is shown as abutting the oven body where second arm 100 of locking lever 94 is positioned within slot 102. Upon movement of actuation knob 24 along the length of slot 26, the locking lever 94 is rotated to the position as shown in FIG. 9 where the second arm 100 of the locking lever is within the oven body and cannot be withdrawn so that the oven door is thereby locked shut. The tab 108 abuts the stop 106 in moving the link arm 80 to the right. This movement of link arm 80 causes link arm 76 to pivot about point 78 and raise the shield to the position shown in FIG. 3. Due to there being other functions served by locking lever 94 moving to the position shown in FIG. 9, such as tripping microswitches and the like to activate the self-cleaning cycle in the oven, there is usually some play in the movement of the locking lever 94. If the actuation knob were secured to link arm 80, movement in the opposite direction while the oven is on the self-cleaning cycle may permit lowering of the shield 22 and exposing the transparent pane 20 to thermal radiation of the oven. To accommodate this possible play in the locking arm 94, the tab 108 may move along arm 80 to second stop 104 before causing movement of link arm 80. This freedom of movement between stops 104 and 106 is to accommodate any freedom of movement of locking lever 94. Movement of the actuation knob 24 to the left as shown in FIG. 10 accommodates freedom of play of the locking arm 94 without lowering the shield 22.

The track system according to the invention includes a spring detent to releasably hold the shutter 22 in the up position. This is shown in FIG. 3 where detent stop 112 is secured to channel 60 and a spring catch 114 is secured to shield 22. When the shield 22 is raised to the position shown in FIG. 3, spring catch 114 rides up over detent stop 112 and engages the upper edge of detent stop 112 to hold the position of the shield 22. In order to lower the shield 22 the actuation knob 24 is moved to the left and upon the tab 108 engaging stop 104, the spring catch 114 is released from the upper edge of detent stop 112 due to the downward force exerted by lever arm 76 so that the shield 22 is released and drops by gravity to the position shown in FIG. 2. As can be appreciated, with this freedom of play in the actuation knob 24 to accommodate free movement of the locking lever 94, there is no chance of lowering the shield 22 while the oven is in its self-cleaning cycle.

Figure 6:
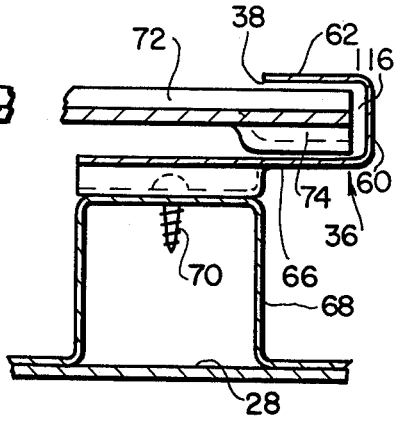
FIG. 6 is a section taken along the lines 6—6 of FIG. 2.

With the shield 22 in the raised position and the oven door locked in preparation for the self-cleaning cycle, the oven is raised to very high temperatures. Due to the fact that the shield 22 is suspended in the oven door in a cantilever manner, the second end 38 of the shield is free so as to accommodate thermal expansion in the shield 22 caused by the high temperatures in the oven. As a result, the second end 38 of the shield 22 may move into the space generally designated at 116 of channel 60 as shown in FIG. 6. The depth of the channel 60 is selected such that it is sufficient to accommodate the expected thermal expansion of the shield 22.

As mentioned the channel 60 is provided to reduce the degree of rattle of and to guide the movement of the shield in the oven door. It is understood, however, that other types of guidance means may be provided on the free end of the shield such as pegs which would ride against the inner surface 28 of the oven door to preclude it from hanging up on clips and the like used to secure a transparent pane 20 onto the oven door. Other types of guidance means may be used where it is important that such guidance means accommodate any thermal expansion in the shield 22. In an instance where no guidance means at all is used, the second end 38 of the shield is free to move so that thermal expansion in the shield is accommodated and buckling of the shield is thereby precluded.

The linear motion bearing means according to a preferred embodiment of the invention readily accommodates thermal expansion where the arcuate surfaces 48 and 50 of stationary channel 40 and moveable channel 42 can flex, caused by thermal expansion within the bearing means, and, as a result, retain the shape of the bearing means so that it is operable after the oven is cooled down and it is necessary to lower the shield 22.

It can therefore be appreciated that with this type of mounting of a moveable shield within an oven door, the shield may be raised and lowered without any jamming or cocking of the shield in the oven door, nor is there any buckling caused in the shield due to thermal expansion therein when the oven is operated at high temperatures.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privelege is claimed are defined as follows:

1. In an oven door having a window with a transparent pane for use on an oven, said oven door including spaced-apart outer and inner door panels with aligned apertures which define a window opening, a moveable shield positioned between said outer and inner door panels which is adapted to be moved to a position to cover and to shield said transparent pane from thermal radiation generated by an oven operating at high temperatures and which is adapted to be moved to a position to uncover said transparent pane and leave said window opening unobstructed to permit viewing into an oven, a linear motion bearing means having a first end portion of said moveable shield mounted thereon, said linear motion bearing means being adapted to suspend said moveable shield by said first end portion within said oven door and essentially preclude transverse movement of said moveable shield, means for moving said moveable shield along said linear motion bearing means to a position which covers said transparent pane and for releasably holding said moveable shield in a transparent pane covering position, the arrangement being such that said linear motion bearing means positions and guide movement of said moveable shield to and away from a position which covers said transparent pane, a second end portion of said moveable shield opposite said first end portion being free from support means whereby thermal expansion in said moveable shield is accommodated.

2. In an oven door of claim 1, guidance means being provided for guiding movement of said second end portion as said moveable shield is moved to and away from a position covering said transparent pane, said guidance means being adapted to accommodate movement of said second end portion caused by thermal expansion in said moveable shield.

3. In an oven door of claim 1, a stationary component means of said linear motion bearing means being secured to an interior surface of said outer door panel, said first end being secured to a moveable component means of said linear motion being means which is adapted to permit movement of said moveable shield to and away from said transparent pane covering position.

4. In an oven door of claim 3, said moveable component means being spaced apart from said stationary component means by ball bearings which permit said moveable component means to slide freely relative to said stationary component means.

5. In an oven door of claim 3, said stationary and moveable component means being channel-shaped and adapted for placement of one within the other where a ball bearing race is provided between the two components, said ball bearing race permitting movement of said linear motion bearing means along the longitudinal axis of said stationary component means and essentially precluding any transverse movement of said moveable component means relative to said stationary component means.

6. In an oven door of claim 2, said guidance means guiding the movement of said moveable shield so as to maintain said moveable shield in a plane which is substantially parallel to a plane defined by said transparent pane.

7. In an oven door of claim 6, said guidance means comprising a channel member secured to an interior surface of said outer door panel, said channel member being positioned so as to receive said second end portion of said moveable shield and being adapted to have said second end portion slideably fits therein, said channel member having sufficient depth to accommodate movement of said second end portion further into said channel member which is caused by thermal expansion in said moveable shield.

8. In an oven door of claim 7, said channel having two leg portions each having a free end, the distance between said two leg portions being greater than the thickness of said moveable shield, the second end portion of said moveable shield having raised portions extending away from said moveable shield in both directions towards the interior surfaces of said two leg portions of said channel member.

9. In an oven door of claim 1, said means for moving said moveable shield being operated by actuation means.

10. In an oven door of claim 9, said means for moving said moveable shield being a linkage means mounted between said outer and inner door panels and operated by said actuation means to raise and lower said moveable shield, said actuation means being adapted to lock said oven door shut on an oven when said moveable shield is moved to a position to cover said transparent pane.

11. In an oven door of claim 10, a locking means for locking said oven door shut being engaged by said actuation means to lock and unlock said locking means, said locking means when in a locked position allowing a limited degree of freedom of movement of said actuation means, said linkage means being adapted to permit said limited degree of freedom of movement in said actuation means without moving said moveable shutter so that said moveable shutter remains at a position covering said transparent pane when said oven door is locked.

12. In an oven door of claim 11, said linkage means including a link arm having two spaced apart stops, said actuator means being adapted to slide along said link arm between said two stops, the distance between said two stops being predetermined by said limited degree of freedom of movement permitted by said locking means.

13. In an oven door of claim 1, the means for releasably holding said moveable shield in said transparent pane covering position comprising a detent of a spring catch type mounted on said moveable shield which releasably engages a stationary stop, the location of said detent being such to releasably hold said moveable shield in said transparent pane covering position.

14. In an oven door of claim 10, said actuation means including a knob external of the door which slides back and forth in a slot provided in said outer door panel, the back and forth sliding movement of said knob being translated to said linkage means by said actuation means to raise and lower said moveable shield.

* * * * *